US008123589B2

(12) United States Patent
Chapman et al.

(10) Patent No.: US 8,123,589 B2
(45) Date of Patent: Feb. 28, 2012

(54) SYSTEM AND METHOD OF CONSTRUCTING AND SIZING BRASSIERES

(75) Inventors: Stewart Chapman, West Midlands (GB); Melissa Stewart, Fuguay Varina, NC (US)

(73) Assignee: Jockey International, Inc., Kenosha, WI (US)

( * ) Notice: Subject to any disclaimer, the term of this patent is extended or adjusted under 35 U.S.C. 154(b) by 1042 days.

(21) Appl. No.: 12/035,833

(22) Filed: Feb. 22, 2008

(65) Prior Publication Data

US 2009/0215359 A1 Aug. 27, 2009

(51) Int. Cl.
*A41C 3/00* (2006.01)

(52) U.S. Cl. ..... 450/92; 450/51; 450/52

(58) Field of Classification Search ..... 450/41–45, 450/47, 48, 50–54, 65, 66, 70, 39, 92, 93
See application file for complete search history.

(56) References Cited

U.S. PATENT DOCUMENTS

| | | | | |
|---|---|---|---|---|
| 2,489,591 | A | | 11/1949 | Saffady |
| 2,559,501 | A | | 7/1951 | Graf |
| 2,575,343 | A | | 11/1951 | Heiman |
| 3,092,987 | A | * | 6/1963 | Levine ..... 66/176 |
| 3,400,720 | A | * | 9/1968 | Wark ..... 450/61 |
| 4,024,856 | A | | 5/1977 | Kirianoff |
| 4,219,029 | A | | 8/1980 | Grossman et al. |
| 4,279,259 | A | | 7/1981 | Lee et al. |
| 4,307,517 | A | | 12/1981 | Casselberry |
| 4,338,953 | A | | 7/1982 | Ward |
| 4,454,409 | A | | 6/1984 | Sehres |
| 4,519,137 | A | | 5/1985 | O'Boyle et al. |
| 5,163,006 | A | | 11/1992 | Deziel |
| 5,163,007 | A | | 11/1992 | Slilaty |
| 5,219,311 | A | | 6/1993 | Fildan |
| 5,414,943 | A | | 5/1995 | Vogt |
| 5,485,855 | A | | 1/1996 | Shiraiwa et al. |
| 5,619,804 | A | | 4/1997 | Vogt et al. |

(Continued)

FOREIGN PATENT DOCUMENTS

DE 20206037 8/2003

(Continued)

OTHER PUBLICATIONS

H.-Y. Hyun-Young Lee, Kyunghi Hong, and Eun Ae Kim, "Measurement Protocol of Women's Nude Breasts Using a 3D Scanning Techinique", Applied Ergonomics, vol. 35, Issue 4, pp. 353-359, Jul. 2004, Korea Research Foundation (KRF-2000-042-D00129).

(Continued)

*Primary Examiner* — Gloria Hale
(74) *Attorney, Agent, or Firm* — Michael Best & Friedrich LLP

(57) ABSTRACT

A non-customized standard array of brassieres generated from a grading array including a number of differently-sized bands that each defines an arc. The grading array defines a constant angular band end location across a plurality of band lengths, defines a constant angular cup location for different-sized cups on a single band length as well as for the same or different-sized cups across a plurality of band lengths, and defines a variable bridge distance that varies based on cup size. The non-customized, standard array of brassieres is identifiable by a standard brassiere measuring system where the volume identifier of the cup represents a consistent volume regardless of the band length for which the cup is associated. Further, the standard brassiere measuring system is based on direct body measurements representative of breast volume and underbust circumference.

43 Claims, 13 Drawing Sheets

U.S. PATENT DOCUMENTS

| | | | | |
|---|---|---|---|---|
| 5,759,163 | A | 6/1998 | Hwang | |
| 5,769,779 | A | 6/1998 | Alderson | |
| 5,965,809 | A | 10/1999 | Pechter | |
| 6,044,288 | A | 3/2000 | Wake et al. | |
| 6,101,424 | A | 8/2000 | Sawada | |
| 6,165,045 | A | 12/2000 | Miller et al. | |
| 6,272,761 | B1 * | 8/2001 | Pechter | 33/512 |
| 6,276,069 | B1 | 8/2001 | Chadwick et al. | |
| 6,336,839 | B1 * | 1/2002 | Valli | 450/1 |
| 6,415,525 | B1 | 7/2002 | Watkins | |
| 6,435,386 | B2 | 8/2002 | Scott | |
| 6,447,365 | B1 | 9/2002 | Powell et al. | |
| 6,467,180 | B1 | 10/2002 | Chan | |
| 6,540,702 | B1 | 4/2003 | Sarango | |
| 6,546,309 | B1 | 4/2003 | Gazzuolo | |
| 6,597,369 | B2 | 7/2003 | Mochimaru et al. | |
| 6,640,460 | B1 | 11/2003 | Nabarro et al. | |
| 6,669,483 | B1 | 12/2003 | Leight et al. | |
| 6,746,306 | B2 * | 6/2004 | Brothers | 450/41 |
| 6,820,478 | B1 | 11/2004 | Nabarro et al. | |
| 6,837,771 | B2 | 1/2005 | Falla | |
| 6,869,406 | B1 | 3/2005 | Nabarro et al. | |
| 6,918,812 | B2 | 7/2005 | Giese | |
| 6,953,380 | B2 * | 10/2005 | Brothers | 450/41 |
| 6,968,075 | B1 | 11/2005 | Chang | |
| 6,981,988 | B1 | 1/2006 | Kinsley | |
| 7,070,620 | B2 | 7/2006 | Miller | |
| 7,162,441 | B2 | 1/2007 | Nabarro | |
| 7,204,741 | B2 | 4/2007 | Giese | |
| 7,349,569 | B2 | 3/2008 | Wiemker et al. | |
| 7,385,601 | B2 | 6/2008 | Bingham et al. | |
| 7,425,170 | B1 | 9/2008 | Herbert et al. | |
| 7,442,110 | B2 | 10/2008 | Gaudet et al. | |
| 7,591,707 | B2 | 9/2009 | Yu et al. | |
| 7,871,305 | B2 * | 1/2011 | Cohen | 450/57 |
| 7,955,274 | B2 * | 6/2011 | Lalonde | 600/587 |
| 2003/0115110 | A1 | 6/2003 | Yano et al. | |
| 2003/0195623 | A1 | 10/2003 | Marchitto et al. | |
| 2003/0220048 | A1 | 11/2003 | Toro et al. | |
| 2004/0015109 | A1 | 1/2004 | Villani | |
| 2004/0033756 | A1 | 2/2004 | Whitson | |
| 2006/0009693 | A1 | 1/2006 | Hanover et al. | |
| 2006/0009696 | A1 | 1/2006 | Hanover et al. | |
| 2006/0031047 | A1 | 2/2006 | Bingham et al. | |
| 2006/0075652 | A1 * | 4/2006 | Saladucha | 33/759 |
| 2006/0218045 | A1 | 9/2006 | Wagner | |
| 2007/0027408 | A1 | 2/2007 | Fitzgerald et al. | |
| 2007/0055371 | A1 | 3/2007 | Laghi | |
| 2007/0082579 | A1 | 4/2007 | Baran et al. | |
| 2007/0123148 | A1 | 5/2007 | Heer | |
| 2008/0125675 | A1 * | 5/2008 | Lalonde | 600/587 |
| 2009/0215359 | A1 * | 8/2009 | Chapman et al. | 450/1 |
| 2009/0287119 | A1 * | 11/2009 | Chapman | 600/587 |

FOREIGN PATENT DOCUMENTS

| | | |
|---|---|---|
| DE | 202007002194 | 6/2007 |
| GB | 2201579 | 9/1988 |
| GB | 2355385 | 4/2001 |
| JP | 10060710 | 3/1998 |
| JP | 10262950 | 10/1998 |
| JP | 2003119609 | 4/2003 |
| JP | 2004144727 | 5/2004 |
| WO | 0052416 A1 | 9/2000 |

OTHER PUBLICATIONS

K. Shin, "Patternmaking for the Underwired Bra: New Directions", The Journal of the Textile Institute, vol. 98, No. 4, pp. 301-318, Jul. 27, 2006, Taylor & Francis Group.

Editors W. Yu, J. Fan, S.C. Harlock, and S.P. Ng, "Innovation and Technology of Women's Intimate Apparel", The Textile Institute, portions of pp. 45-57, 76-93, and 112-113, 2006, Woodhead Publishing Limited, Cambridge, England.

Rong Zheng, Winnie Yu, and Jintu Fan, "Development of a New Chinese Bra Sizing System Based on Breast Anthropometric Measurements", International Journal of Industrial Ergonomics, vol. 37, pp. 697-705, 2007.

European Search Report for EP 08011175.

* cited by examiner

SYSTEM AND METHOD OF CONSTRUCTING AND SIZING BRASSIERES

BACKGROUND

The present invention relates to women's support undergarments, and more particularly, to a system and method of constructing and sizing women's brassieres.

Brassieres are commonly worn by women under their clothing to support their breasts. A brassiere, more commonly known to consumers as a bra, typically includes cups to support the breasts and wing portions that attach to the cups and encircle the upper torso of the woman to hold the bra on the woman's body. Traditional bra design and sizing is not consistent across designers and involves the use of mathematical equations and analysis to translate direct body measurements into a suggested bra size based on adjusted or indirect body measurements. It is thus desirable to provide a system and method of constructing and sizing brassieres that is directly related to body measurements to provide a comfortable and well-fitted bra based on a sizing system that is easy for a consumer to understand.

SUMMARY

The present invention relates to a non-customized, standard array of brassieres that is constructed based on a grading array extracted from scanned body data. The non-customized, standard array provides a plurality of commercially available, non-customized standard brassieres for the consumer. The standard array fits a wide range of the consumer population based on the compiled scanned body measurements. However, unlike the prior art, which in some cases can provide individually customized brassieres based on specific measurements of an individual consumer, the commercially available standard array of brassieres formed from the process of the present invention are not individually customized to each individual consumer's measurements.

The grading array is built from a number of differently-sized bands that each defines an arc. The grading array defines a constant band end location based on a constant angular position on the arc relative to the centerline across a plurality of band lengths. The grading array also defines a constant cup location based on a constant angular position on the arc relative to the centerline for different-sized cups on a single band length as well as for the same or different-sized cups across a plurality of band lengths. The grading array further defines a variable bridge distance (i.e., the distance between cups on a brassiere) that varies on a single band length based on cup size and varies across a plurality of band lengths across the grading array based on cup size and band length.

The non-customized, standard array of brassieres is identifiable by a standard brassiere measuring system where the volume identifier represents a consistent volume regardless of the band length for which the volume group is associated. Further, the standard brassiere measuring system is based on direct body measurements representative of breast volume and underbust circumference.

In one embodiment, the invention provides a non-customized standard array of brassieres. The standard array of brassieres includes a plurality of fabric bands generated from a corresponding plurality of bands of varying lengths. Each of the plurality of bands includes a center point, a first end point on one side of the center point, and a second end point on the opposite side of the center point. The center point, the first end point, and the second end point of a corresponding band define an arc having a substantially constant radius. The first end point of each of the plurality of bands is located at an angular distance from the center point of the corresponding band. The angular distance is constant across the plurality of bands.

In another embodiment, the non-customized standard array of brassieres includes a plurality of cup pairs based on a corresponding plurality of breast volumes. The plurality of cup pairs have different sizes. The standard array also includes a plurality of fabric bands including a first plurality of fabric bands having a common length, and a second plurality of fabric bands having different lengths relative to each other. One cup pair of the plurality of cup pairs is attached to each fabric band. Each fabric band of the plurality of fabric bands includes a bridge defined by the distance between the cups of the cup pair attached to the fabric band. The distance varying across at least one of the first plurality of fabric bands and the second plurality of fabric bands.

In another embodiment, the non-customized standard array of brassieres includes first and second brassieres of a non-customized, standard array of brassieres. The first brassiere includes a first fabric band having a first length and a first cup pair attached to the first fabric band and including a volume identifier. Each cup of the first cup pair is configured to contain a specified volume corresponding to a predetermined breast volume. The second brassiere including a second fabric band having a second length different from the first length. The second brassiere including a second cup pair attached to the second fabric band and including the volume identifier. Each cup of the second cup pair is configured to contain the specified volume corresponding to the predetermined breast volume.

In another embodiment, the non-customized standard array of brassieres includes a plurality of cup pairs, a plurality of fabric bands generated from a plurality of bands including a first plurality of bands of varying lengths and a second plurality of bands having a common length. Each of the plurality of bands including a center point, a first end point on one side of the center point, and a second end point on the opposite side of the center point. The center point, the first end point, and the second end point define an arc having a substantially constant radius. One cup pair of the plurality of cup pairs is attached to each fabric band. A cup of each cup pair of the plurality of cup pairs is located at an angular distance from the end point of the corresponding band. The angular position is constant across at least one of the first plurality of bands and the second plurality of bands.

In another embodiment, the non-customized standard array of brassieres includes a plurality of brassieres. Each brassiere of the plurality of brassieres includes a fabric band having a length identifier equaling a predetermined underbust size, and a cup pair attached to the fabric band. The cup pair includes a volume identifier corresponding to a predetermined breast volume. Each brassiere of the plurality of brassieres is identifiable by a consumer by the volume identifier and the length identifier.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
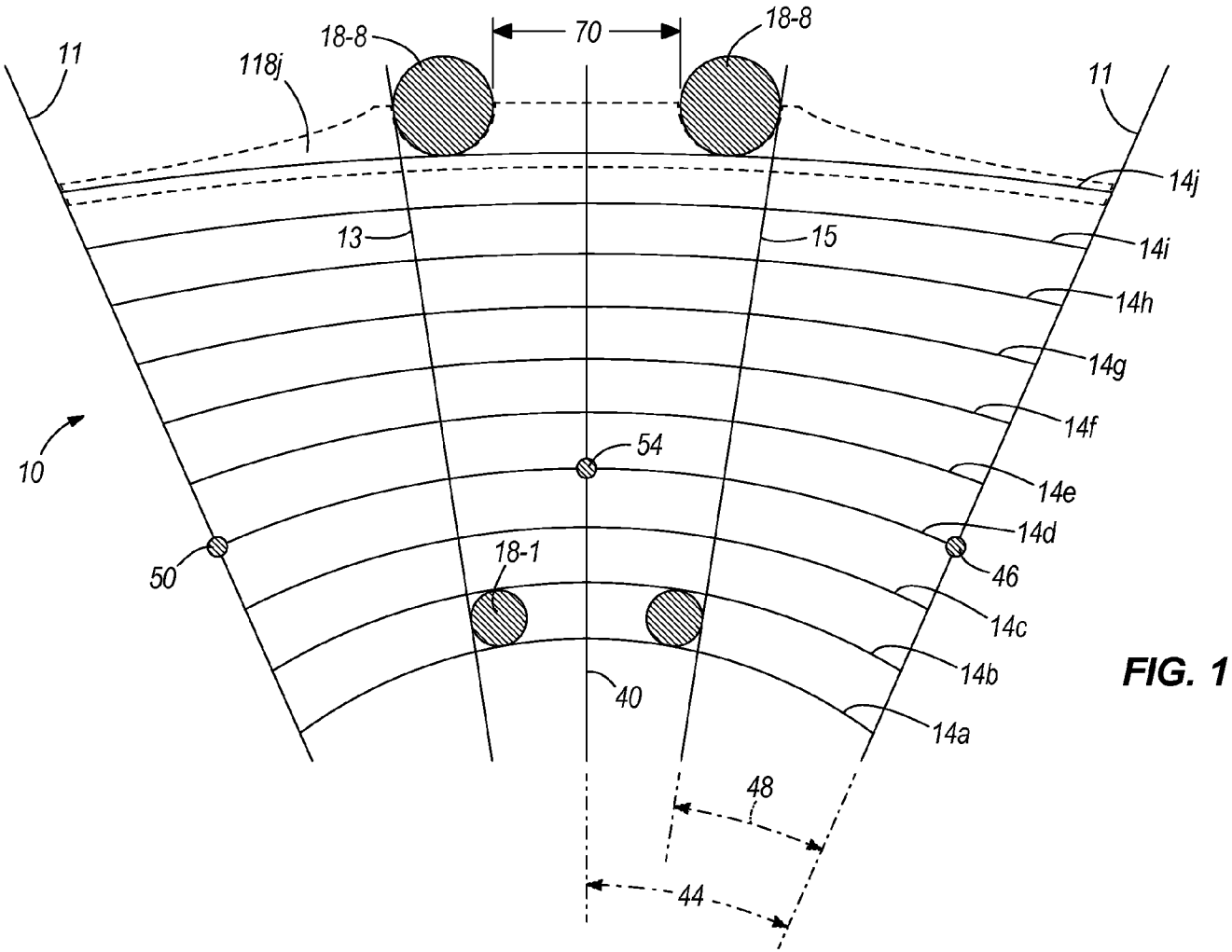
FIG. 1 is a grading array for a non-customized, standard array of brassieres according to one embodiment of the present invention.

FIG. 1 illustrates a grading array 10 according to one embodiment of the present invention. The grading array 10 includes ten bands 14*a*, 14*b*, 14*c*, 14*d*, 14*e*, 14*f*, 14*g*, 14*h*, 14*i*, 14*j* corresponding to ten underbust measurement ranges (26 up to but not including 28 inches, 28 up to but not including 30 inches, 30 up to but not including 32 inches, 32 up to but not including 34 inches, 34 up to but not including 36 inches, 36 up to but not including 38 inches, 38 up to but not including 40 inches, 40 up to but not including 42 inches, 42 up to but not including 44 inches, and 44 up to but not including 46 inches, respectively). Each band 14 is used as a foundation to build a band pattern 118 and ultimately a fabric band 150 (FIG. 21) for a brassiere 152, and thus the grading array 10 is the foundation to build a non-customized, standard array of brassieres 152.

The grading array 10 is based on three-dimensional measurement and analysis of the human anthropometric form. More specifically, the measurement and analysis relate to the female upper torso focusing on the volume of the breast and underbust shape to develop a sizing system for improved overall fit and comfort of brassieres 152 on women. The three-dimensional data is collected via laser scanning techniques, and in the present invention, involves the scanning of over 400 female bodies with their breasts unsupported. The over 400 female bodies is a representative sample of bodies within the female population.

Figure 2:
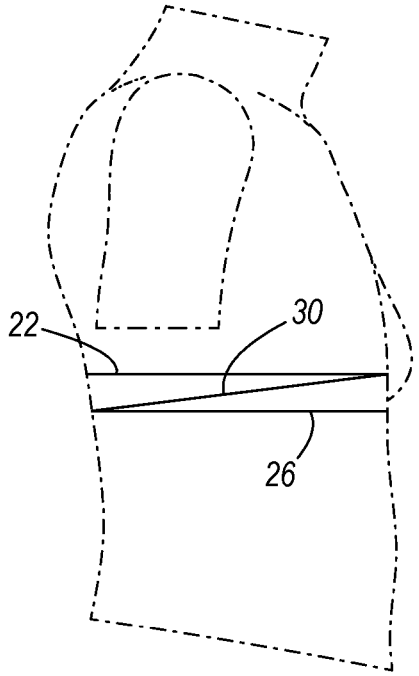
FIGS. 2-3 illustrate the process for constructing a girth band.
Figure 3:
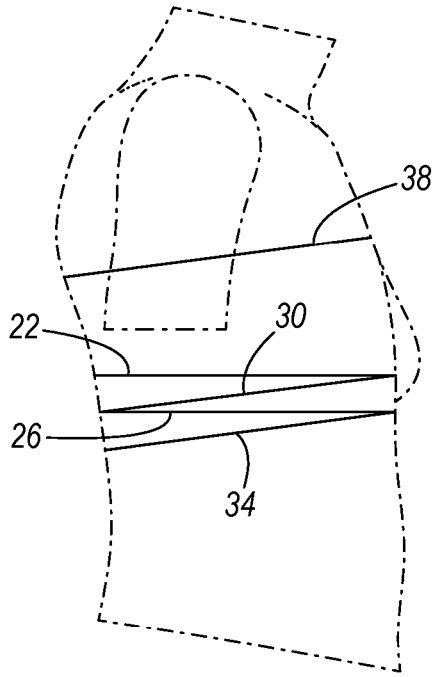
Figure 4:
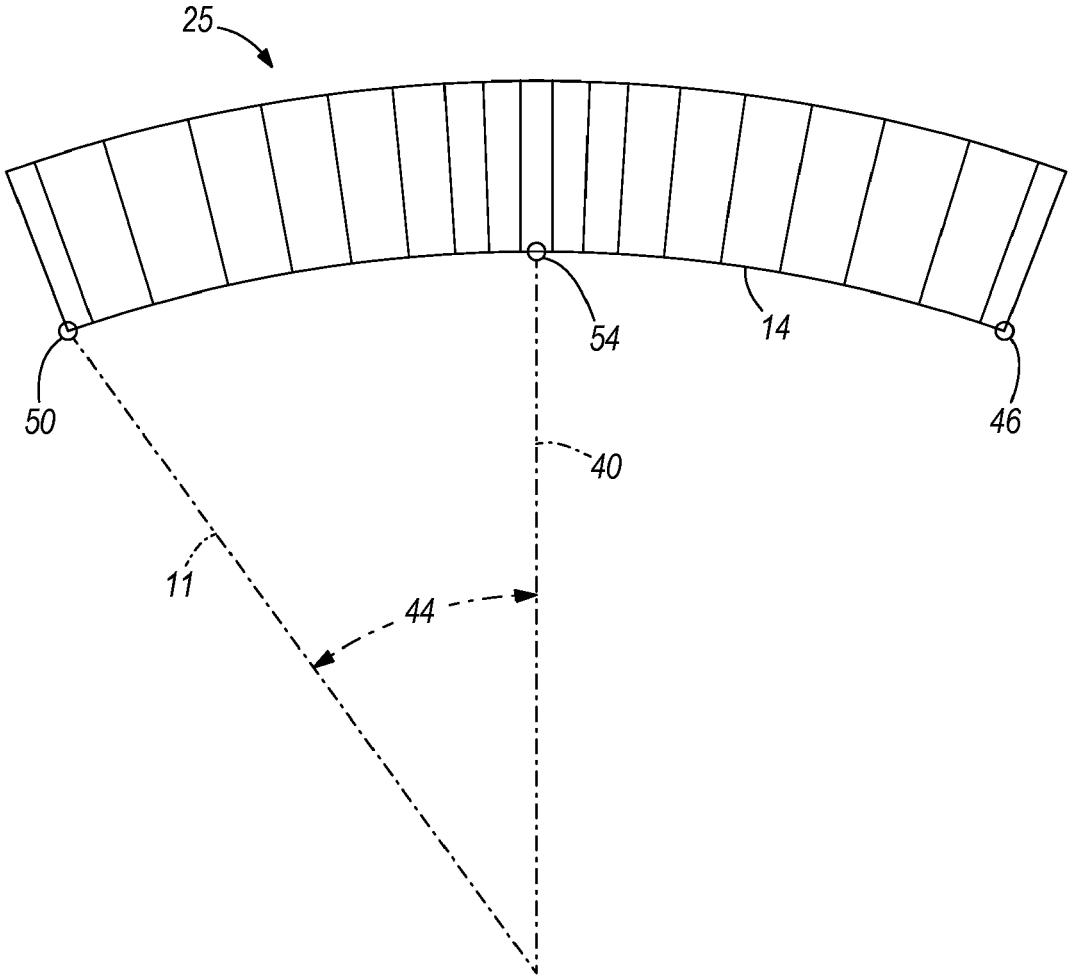
FIG. 4 illustrates the girth band as shown in FIG. 3 laid flat in two dimensions.

As shown in FIGS. 2-4, the grading array 10 is developed in multiple stages. First, underbust measurements are assessed. In building the grading array 10, the underbust measurements of the scanned participants ranged from 26.25 inches to over 50 inches. Using this information, the underbust measurement ranges for the grading array 10 are created at two-inch increments beginning at a 26-inch direct underbust measurement and ending at a 44-inch direct underbust measurement. In other embodiments, the grading array may have higher or lower measurement ranges for both the maximum and minimum ranges. The selected ranges on the grading array 10 offer an improved fit for a greater percentage of the female population over traditional brassiere sizes that presently range to fit underbust measurements of approximately 30 to 48-inches.

In order to generate the bands 14*a*-14*j* in the grading array, the scanned data is manipulated to create a brassier 152 that will sit lower on a back of a woman so as to keep the brassiere 152 from moving up on the back of the wearer while being worn. With reference to FIG. 2, for each scanned model having an underbust measurement within the 26 to 44 inch ranges a first horizontal plane 22 is placed at the location of the sixth rib. A second horizontal plane 26 is offset at, for example, a one-inch drop from the location of the sixth rib. In other embodiments, and depending on the bra style and design, the second horizontal plane may be offset by other measurements, including but not limited to, a greater or lesser offset than a one-inch drop from the location of the sixth rib. The first horizontal plane 22 and the second horizontal plane 26 are connected with a diagonal plane 30. Next, as shown in FIG. 3, the diagonal plane 30 is moved downward one-inch to create a sloped plane 34 with a one-inch drop from center-front to center-back with reference to the scanned female torso. The sloped plane generates brassieres 152 that will reduce the rise generated during typical wear of the brassieres 152. Next, a second diagonal plane 38 is created at, for example, a five-inch offset from the first diagonal plane to generate the girth band 25. In other embodiments, and depending on bra style and design, the second diagonal plane may be offset by other measurements, including, but not limited to, a greater or lesser offset than a five-inch offset from the first diagonal plane. As shown in FIG. 4, the dimensions of the girth band 25 from the scanned model are then imported into a CAD software system to generate a two-dimensional girth band 25. Essentially, the software opens the enclosed loop of the girth band 25 from the three-dimensional model of FIG. 3, separates the loop along the center back location, and lays the now-opened loop flat as shown in FIG. 4.

The angle 44 defined by the span of the girth band 25 is then measured, and averaged for all of the scanned models within the 26-inch to 44-inch underbust measurement ranges. Each girth band includes a first end point 46, a second end point 50, and a center point 54 that together define an arc or band 14. The resulting angle 44 of all of the two-dimensional girth bands 25 measured along the arc 14 from a centerline 40 to an end of the girth band 25 has a mean of approximately 22.4 degrees and a median of approximately 23 degrees (i.e., an angle of 46 degrees is defined between the ends of the averaged girth band 25). Using the 23-degree angle from the centerline 40 as well as the averaged arc 14 from girth bands 25 of all the scanned models in each underbust measurement range, the three-point arcs 14*a*-14*j* were created for each of the underbust measurements ranges from 26 inches to 44 inches to give the basis of the grading array 10. Each band 14 on the grading array 10 includes the first end point 46, the second end point 50, and the center point 54 of the averaged girth band 25 for that specific underbust measurement range. Each band 14*a*-14*j* has a substantially constant radius, and the radius of each band is different from the radii of the other bands in the grading array 10. Further, the value of 23 degrees is used as the value for the angle 44, which defines a first index line 11 on the grading array 10. In other embodiments, the angle 44 is within the range of 15-30 degrees, and more particularly within the range of 20-25 degrees.

Figure 5:
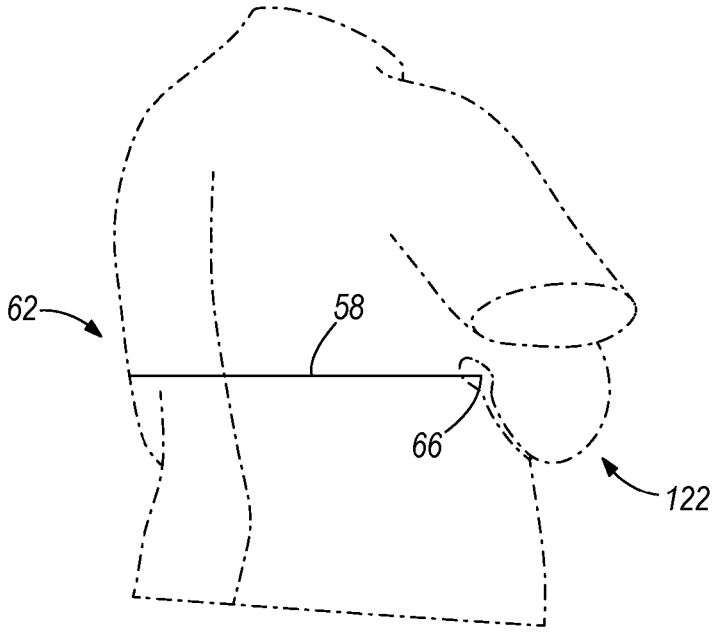
FIG. 5. illustrates a center-back to breast-side-crease distance measurement.

As shown in FIG. 5, the second stage is the review and assessment of center-back-to-breast-side-crease measurements, which will determine the breast cup 18 location on the grading array 10 and ultimately the breast cup location on the brassiere. First, the distance from the crease mark 62, or the side of the breast tissue, of the left breast to the crease mark 66 of the right breast is measured for each of the scanned participants and averaged for all of the scanned models within each of the 26-inch to 44-inch underbust measurement ranges. In other words, these measurements are then segmented into each of the underbust measurement ranges. The distance of the crease-to-crease measurement 58 is divided in half, thereby yielding the distance from the center-back to the crease mark. The center-back to breast-side-crease measurements range from 8.2 inches to 15.16 inches. The minimum value of 8.3 inches corresponds to the arc 14*a* on the grading array, and increases in a non-linear fashion with every subsequent band to a value of 13.5 inches on the arc 14*j* of the grading array 10.

Using this data, and measuring back on the bands 14 from the first index line 11, second index lines 13, 15 are positioned on the grading array 10 at a constant pitch angle 48 over the bands 14 of the grading array 10. The angle 48 is calculated as approximately 14.75 degrees. Pitch angle 48 is applied to both sides of the grading array 10 and defines portions of the band 14 commonly referred to as the left and right wing components of a brassiere. The sizes may be extended below 26 inches or beyond 44 inches, while keeping within the standard array index lines 13, 15 at 14.75 degrees and 23 degrees in order to accommodate specific markets. For example, a band size below 26 inches may be applicable to teenage or adolescent markets, whereas, a band size above 44 inches may be applicable to queen or plus-size markets. In some embodiments, the grading array may have a pitch angle 48 that is less than or greater than 14.75 degrees to account for any variances, such as including, but not limited to, fabric stretch, cultural population differences, style changes, but which will still produce a similar comfort-fitting brassiere. In other embodiments, the pitch angle is within the range of 5-25 degrees, or more particularly 10-20 degrees.

The third stage in building the grading array 10 is the review and assessment of breast volumes. The brassiere system utilizes the volume of the breast as one of the measurement components for brassiere selection. In the illustrated embodiment, there are eight volume groups identified in the standard array of brassieres 152 which are determined from statistical analysis and clustering effects of the data collected from the scanned study participants. Each volume group corresponds to a cup size 1-8 (represented in the Figures as 18-1, 18-2, 18-3, 18-4, 18-5, 18-6, 18-7, and 18-8) containing the predetermined volume of the respective volume group. In other embodiments, the volume groups may be represented by their respective volume size, a color, a shape, a letter, a graphic, a name, or other type of identification. In contrast to the process of the present invention, traditional cup sizes in the US market are AA, A, B, C, D, DD, and E. Each cup is associated with numerous band sizes, and each cup size is not representative of a consistent volume because the volume of the cup size will vary between manufacturers as well as vary between band sizes for a single manufacturer.

To determine the breast volumes to build the grading array of the present invention, the left and right breasts of each scan participant are extracted from the torso of the initial data collection scan. The individual breast volumes of the participants are grouped according to clusters of volumes among participants. By clustering the volumes, the breast volumes fall into eight main volume groups as illustrated in Table 1 below. In other embodiments, additional volume groups may be added above or below the eight main volume groups illustrated in Table 1.

TABLE 1

| Volume Group | Volume (cc) |
|---|---|
| 1 | 203 |
| 2 | 348 |
| 3 | 499 |
| 4 | 658 |
| 5 | 814 |
| 6 | 994 |
| 7 | 1154 |
| 8 | 1332 |

With reference to Table 1, cup 18-1 relates to volume group 1, cup 18-2 relates to volume group 2, cup 18-3 relates to volume group 3, cup 18-4 relates to volume group 4, cup 18-5 relates to volume group 5, cup 18-6 relates to volume group 6, cup 18-7 relates to volume group 7, cup 18-8 relates to volume group 8. The actual volume of any cup 18-1-18-8 is the same regardless of the size of the brassiere to which it is associated. That is, the volume identifier for each cup represents the same volume regarding of the size of the brassiere it is attached. For example, cup 18-3 has a breast volume amount of 499 cc. This volume amount is constant for women with direct underbust measurements ranging from 28 up to but not including 30 inches to 42 up to but not including 44 inches (Table 3). In contrast, in traditional brassieres, 36DD and 44DD cups are not equivalent in cup volume capacity. Accordingly, in the traditional brassiere sizing system, there is no direct volume definition for a particular cup letter or volume identifier. Typically, the traditional brassiere sizing system grades cups in increments of quarter-inches that increases in four directions (North, South, East, West) from the center of the cup.

Furthermore, in comparison of volume to cup sizing, traditional cup sizing utilizes cross grading of cups. For example, in traditional brassiere sizing, the cup used for a 34C brassiere is also used for 36B brassiere. Table 2 illustrates typical cross grading of cups for traditional brassiere sizing methods. In Table 2 below, the same sized cups are used for all bras located within a particular column.

TABLE 2

| | | | | | | | | | | |
|---|---|---|---|---|---|---|---|---|---|---|
| 32A | 34A | 36A | 38A | 40A | | | | | | |
| | 32B | 34B | 36B | 38B | 40B | 42B | | | | |
| | | 32C | 34C | 36C | 38C | 40C | 42C | 44C | | |
| | | | 32D | 34D | 36D | 38D | 40D | 42D | 44D | |
| | | | | 32DD | 34DD | 36DD | 38DD | 40DD | 42DD | 44DD |

Unlike traditional brassiere sizing methods, the system of the present invention does not cross grade across volume groups. Although each of the eight volume groups can be represented in the each of the band sizes, it has been determined from statistical analysis that the underbust measurement and volume groupings illustrated in Table 3 are capable of fitting over approximately 85% of the female population. With reference to Table 3, the volumes per group are related back to the underbust measurement within the grading array 10.

TABLE 3

| Underbust Measurement (in) | Volume Group 1 (203 cc) | 2 (348 cc) | 3 (499 cc) | 4 (658 cc) | 5 (814 cc) | 6 (994 cc) | 7 (1154 cc) | 8 (1332 cc) |
|---|---|---|---|---|---|---|---|---|
| 26-28 | X | | | | | | | |
| 28-30 | X | X | X | X | | | | |
| 30-32 | X | X | X | X | | | | |
| 32-34 | X | X | X | X | X | X | | |
| 34-36 | X | X | X | X | X | X | X | |
| 36-38 | | X | X | X | X | X | X | X |
| 38-40 | | X | X | X | X | X | X | X |
| 40-42 | | | X | X | X | X | X | X |
| 42-44 | | | X | X | X | X | X | X |
| 44-46 | | | | | X | X | X | X |

Figure 6:
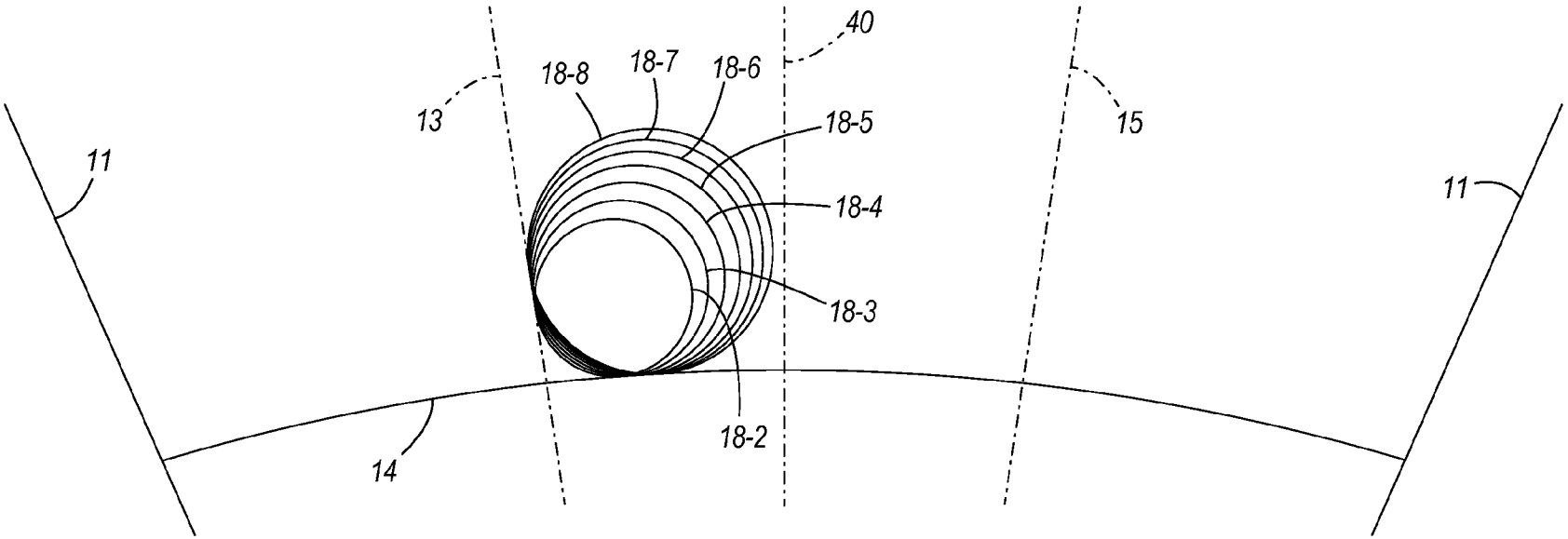
FIG. 6 illustrates one band from the grading array of FIG. 1, illustrating the positions of multiple cup sizes on the band.

With reference to FIGS. 1 and 6, the various brassiere cups 18 can then be located onto the grading array 10. The grading array 10 provides for the proper and consistent placement of the cups 18 on the band 14 regardless of the underbust measurement or the cup size. As shown in FIG. 6, the band 14 (either 14*c* or 14*d*) can be associated with cups 18-2-18-8. The cups 18-2-18-8 are placed onto the grading array 10 and represented by a circle (as determined by a ½ sphere having the same volume) onto the grading array 10. For example, volume group 4 has a radius of 2.677 inches. The side of the circle 18 must lay tangent to the index line 13, 15 produced by the 14.75 degree pitch angle 48. Additionally, the bottom of the circle 18 must touch the base line of the band 14. This locating method is used for all bands 14 to position all the cups 18 that are associated with that particular band 14.

Traditional brassiere design utilizes brassiere patterns that use the placement of the center-front to direct the location of the brassiere cups. Traditional brassiere design also does not use any angle to either place the brassiere cup or to produce the curvature of the band. As the center-front portion is graded taller for each increase in cup size, the placement of the brassiere cup changes to reflect the height of the center-front position. Accordingly, the curvature of the band and the placement of the brassiere cups are variable among brassiere designers and pattern makers.

With reference to FIG. 1, once the circle 18 with the corresponding diameter for the volume group is placed on the grading array 10, the center-front measurement 70 (or bridge) is determined. The center-front measurement 70 is the band length 14, minus the center-back to breast-side-crease measurements on the left and right sides minus the diameters of the cup circles 18 on the left and right sides. There are various center-front sizes of each band size similar to the plurality of volume groups for each band size. The center-front measurement contributes to central positioning of the breasts in an appropriate position for a given silhouette, which provides a more natural and comfortable position in the brassiere design. The center-front may be a fabric, metallic, plastic, or other material component. The center-front measurement 70 provides the bridge between the breast cups 18. The process of the present invention contrasts with traditional brassiere patterning wherein the center-front is the first component utilized in pattern building and wherein the center-front component generally has minimal to no change in horizontal component when grading to a smaller or larger cup size. Rather, grading in the traditional systems is generally completed in the vertical component.

Figure 7:
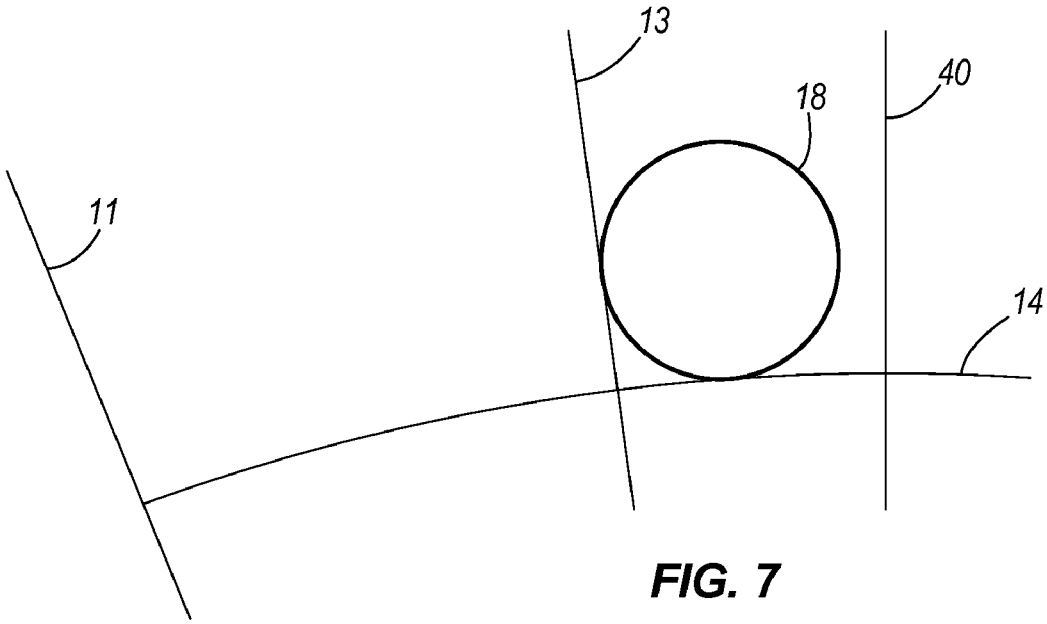
FIGS. 7-17 illustrate the process for building a band pattern from the bands of the grading array of FIG. 1.

FIGS. 7-17 illustrate the process for developing a band pattern 118 from the grading array 10. This process is completed with an electronic pattern processing system. First, with respect to FIG. 7, each band 14 is separated by size, and the volume group circles 18 are retained on the underband arc 14. For example, band 14*a* has only one volume cup 18-1, whereas band size 14*e* has seven volume cups 18-1-18-7. The volume circles and bands 14 are linked for every possible combination of band 14 and volume group of the grading array 10 identified in Table 3. FIG. 7 represents one such combination and the making of the band pattern 118 from the grading array 10 will be described relative to this combination. Is should be understood that all other band patterns can be generated from the remaining combinations in a similar manner. For example, band pattern 118*a* is generated from band 14*a*, band pattern 118*b* is generated from band 14*b*, and so on. Only one band pattern 118*a* is generated because it is only associated with a single cup size 18A. In contrast, four distinct band patterns 118*b* are generated to accommodate the four different cup sizes available for the band 14*b* (cups 18-1, 18-2, 18-3, and 18-4).

Figure 8:
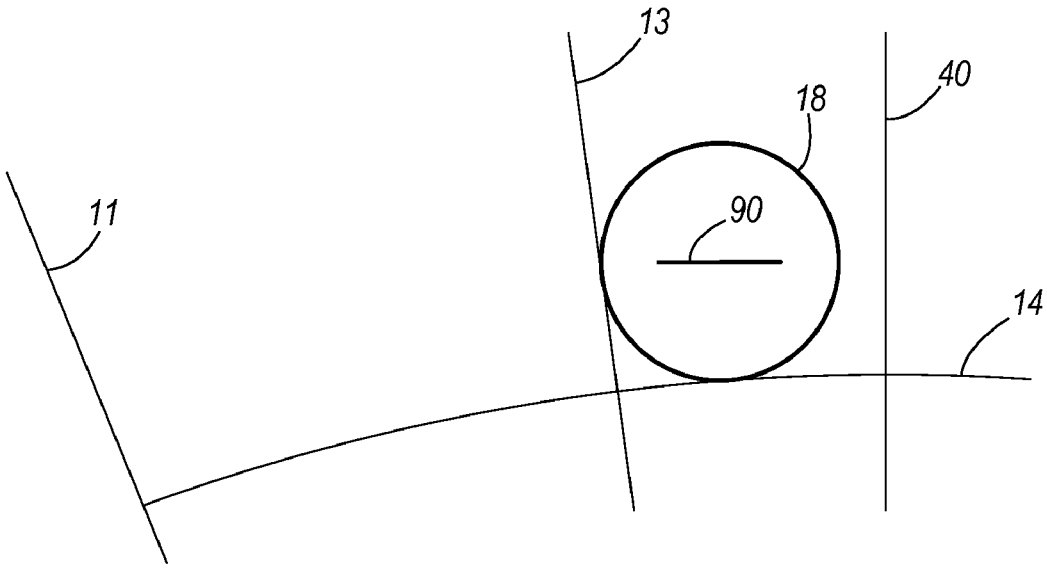
Figure 9:
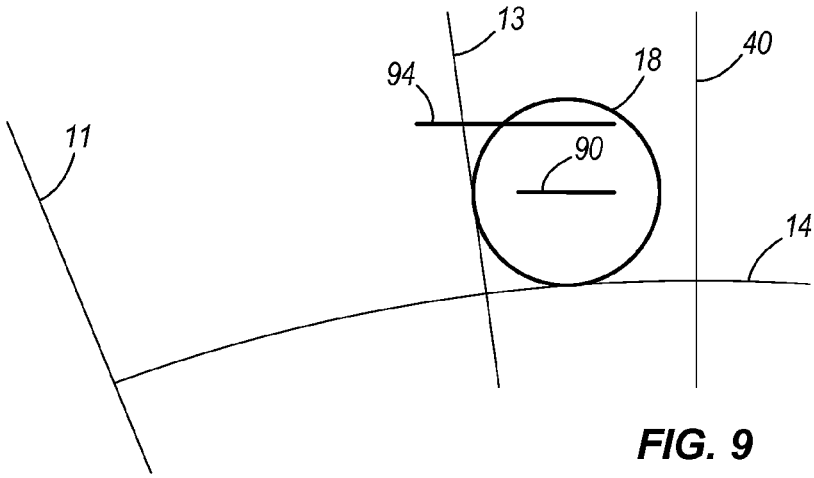
Figure 10:
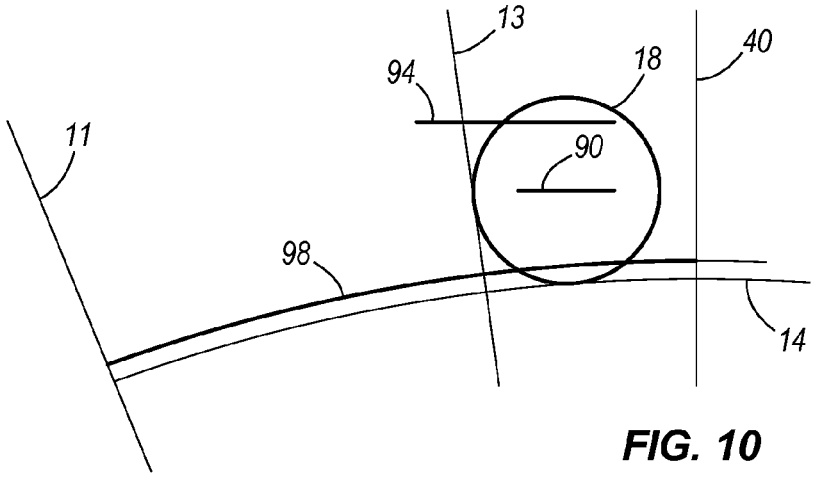
Figure 11:
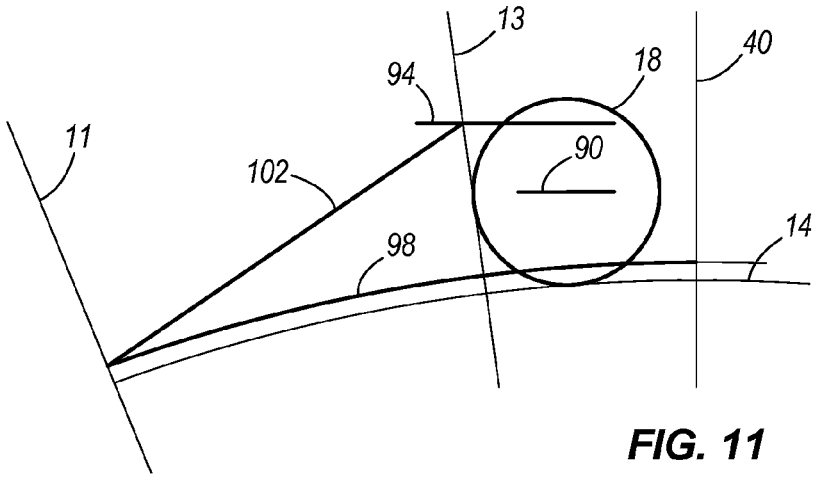
Figure 12:
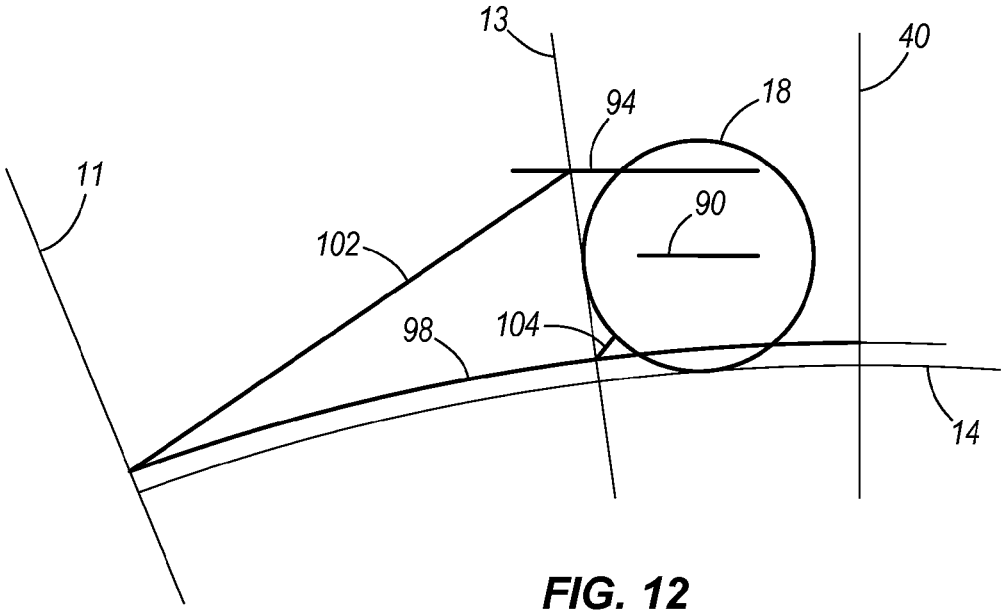
Figure 13:
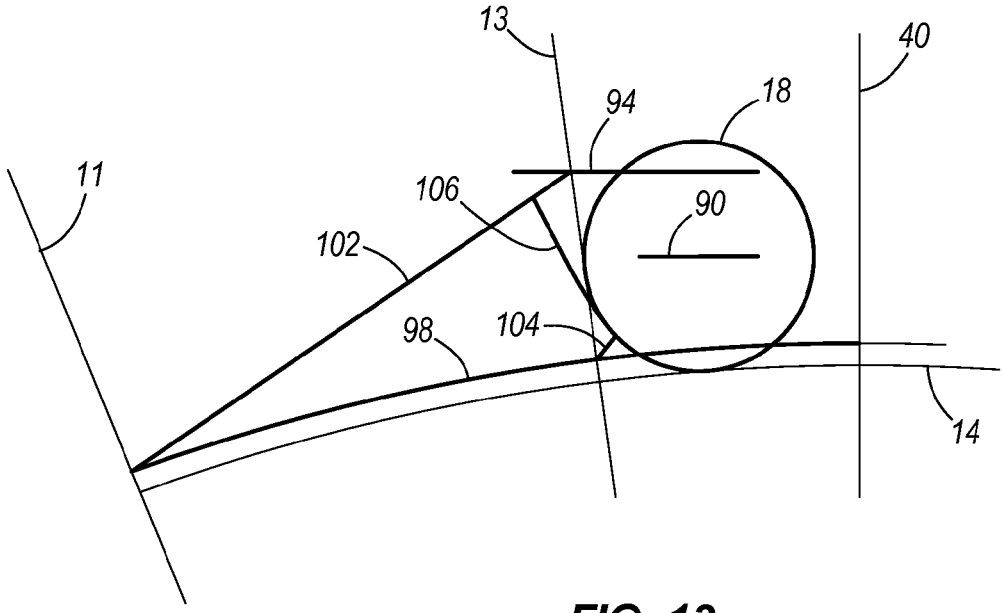
Figure 14:
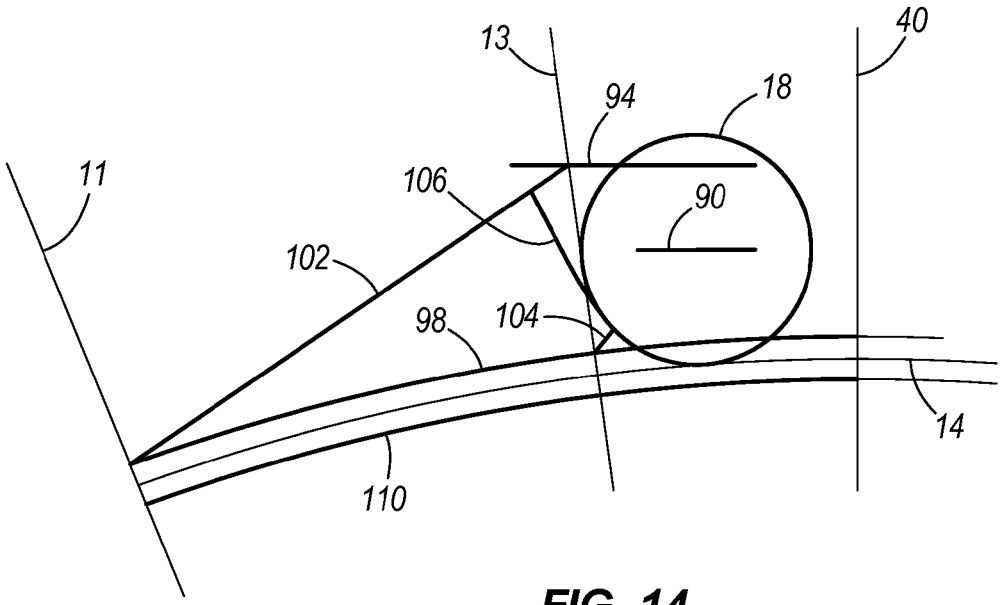
Figure 15:
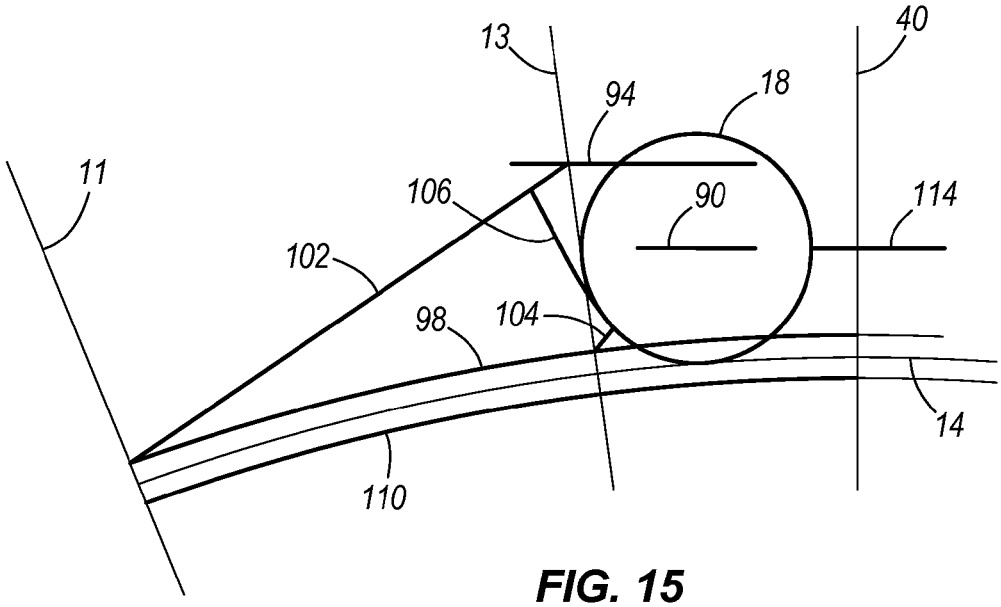
Figure 16:
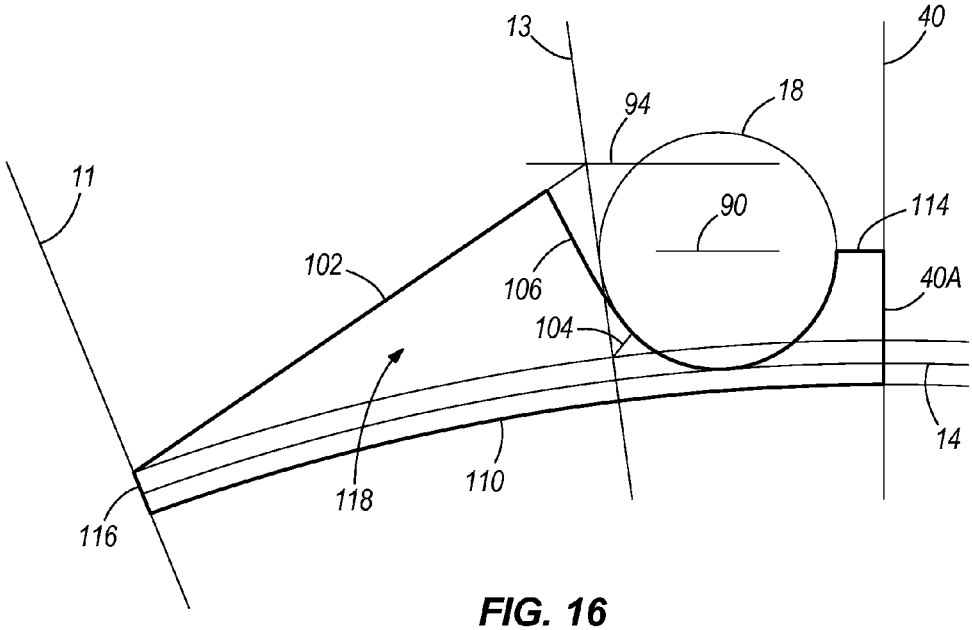
Figure 17:
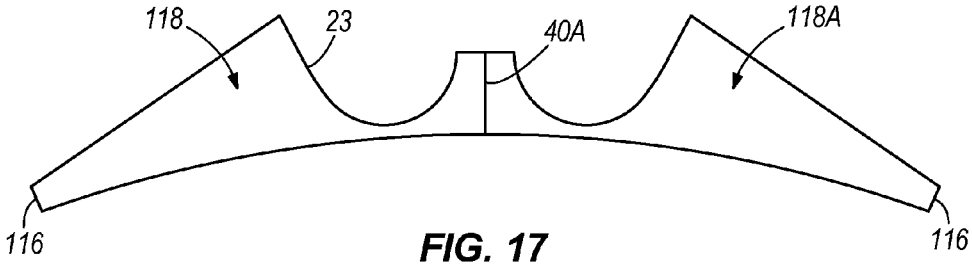

With reference to FIG. 8, a horizontal line 90 is drawn through the center of the circle 18. FIG. 9 shows a horizontal line 94 offset two inches from the center of circle 18. With reference to FIG. 10, an arc 98 is created at, for example, a 0.5-inch offset up from the bottom band 14. In other embodiments, and depending on bra style and design, the arc can be created at a greater or lesser offset than a 0.5-inch offset up from the bottom band. A line 102 is drawn from the intersection of the line 98 and index line 11 and the 2-inch offset horizontal line 94 and the index line 13 as shown in FIG. 11. Next, with reference to FIG. 12, a line 104 is drawn from the intersection of the index line 13 and the arc 98 perpendicular to the circle 18. Line 104 splits the included angle between index line 13 and the arc 98 approximately in half. A curve 106 drawn from the intersection point of line 104 on the circle 18 to a point located one-inch downward on line 102 from index line 13. FIG. 14 shows another arc 110 is created at, for example, a 0.5-inch offset downward from the band 14. In other embodiments, and depending on bra style and design, the arc may be offset at a greater or lesser offset than 0.5-inch offset downward from the bottom band. FIG. 15 shows a new line 114 that is an extension of line 90 from the circle 18 to center line 40. FIG. 16 shows the completion of the pattern 118 by connecting lines along center line 40 and the line 11. A new central line 40A is added connecting the line 110 to the line 114 along line 40 and a new attachment end line 116 is added connecting the line 110 to line 102 along line 11. FIG. 17 shows the resultant band pattern template or band pattern 118 having a receiving area 23 for receiving a breast cup 18. FIG. 17 also shows the mirror image 118A of the band pattern 118, thereby creating a complete band pattern. As used herein, band pattern may refer to either the half band pattern 118, or the complete band pattern as illustrated in FIG. 17.

Figure 18:
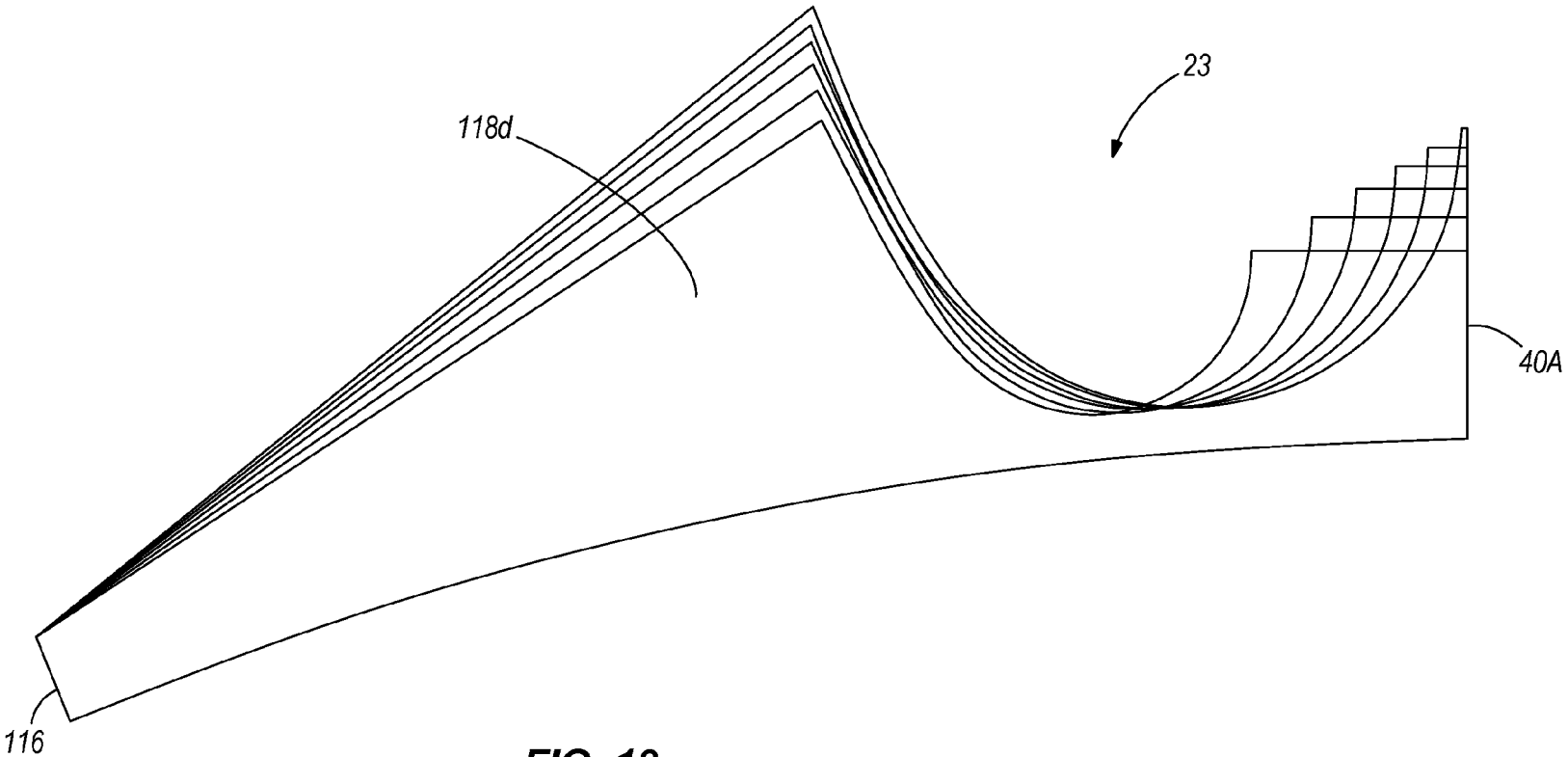
FIG. 18 illustrates multiple band patterns built from the grading array of FIG. 1, illustrating the different band patterns having a common band pattern length for accommodating different cup sizes.
Figure 19:
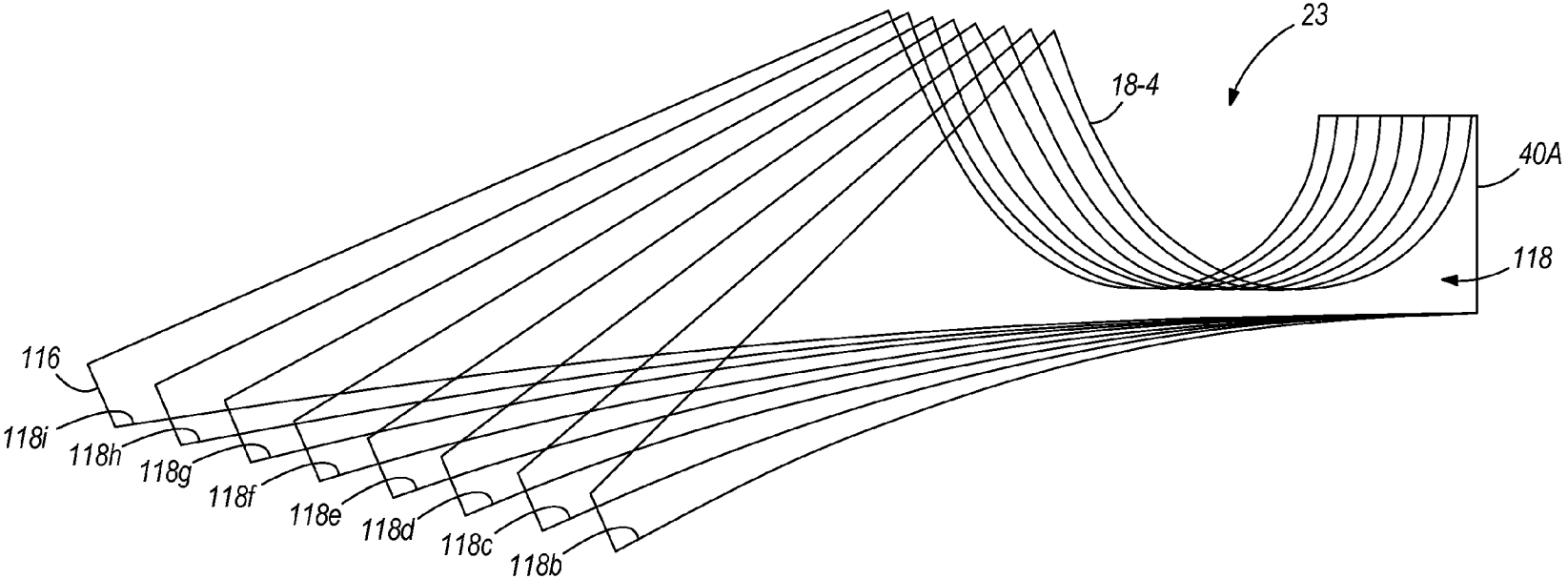
FIG. 19 illustrates multiple band patterns built from the grading array of FIG. 1, illustrating different band pattern lengths for accommodating a common cup size.

As an example, FIG. 18 shows six distinct band patterns 118*d* that corresponds to band 14*d* on the grading array 10. The band patterns 118*d* of FIG. 18 each includes a receiving areas 23 for receiving one of a plurality of volume cup sizes 18-1, 18-2, 18-3, 18-4, 18-5, or 18-6 associated with the band 14*d*. FIG. 19 shows a plurality of band patterns 118*b*, 118*c*, 118*d*, 118*e*, 118*f*, 118*g*, 118*h*, 118*i* each including a receiving area 23 for receiving a volume cup size 18-4.

As seen in FIGS. 18 and 19, attachment ends 116 are located on the end of the band patterns 118. The attachment ends 116 represent the portions of the brassiere that will be connected together around the back of the wearer to hold the brassiere 152 onto the wearer. The attachment ends 130 each define an included angle that equals the angle 44 of about 23 degrees relative to the center line 40A. In other embodiments, the included angle is within the range of 15-30 degrees, or more particularly 20-25 degrees.

Figure 20:
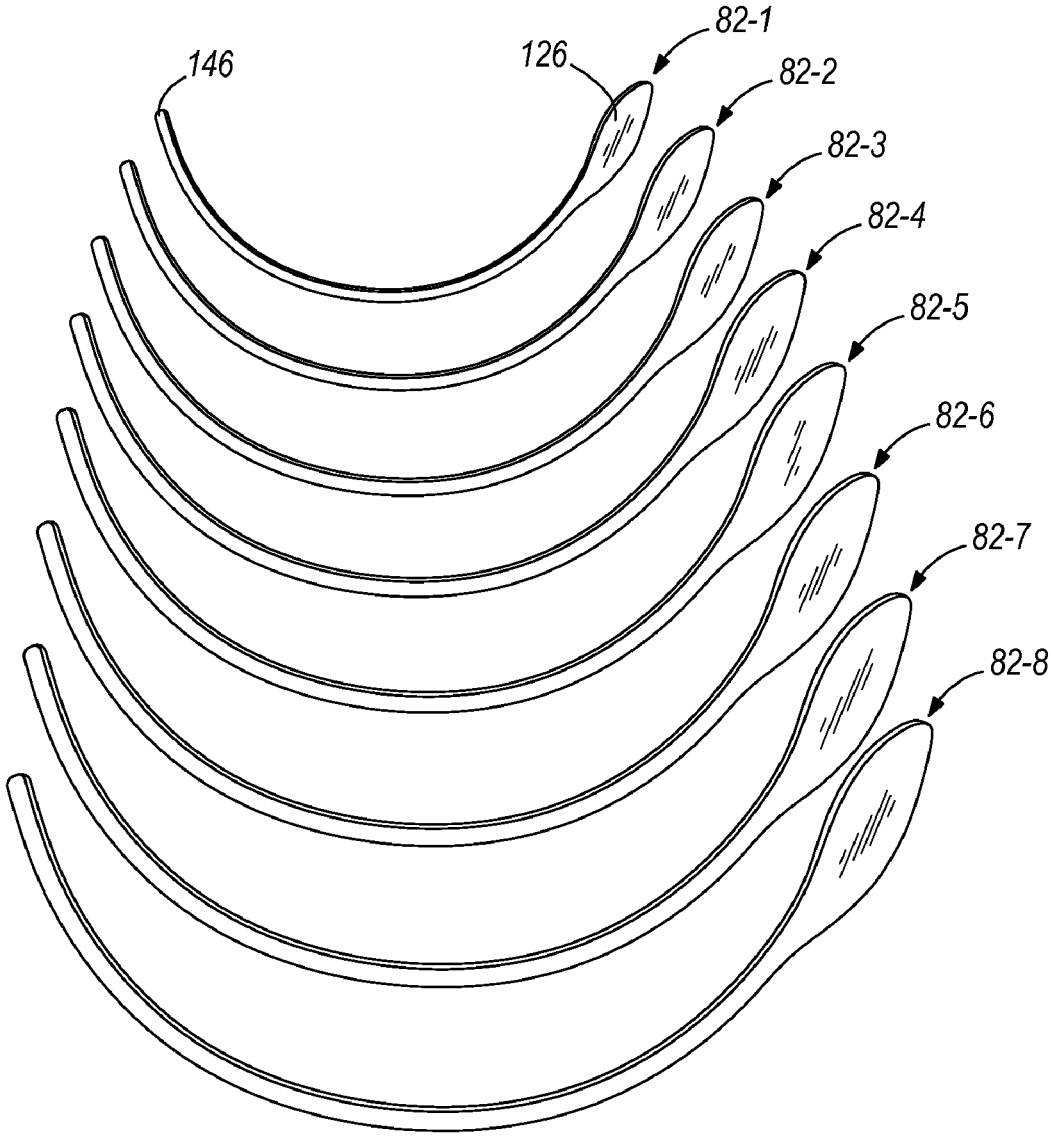
FIG. 20 illustrates armatures associated with different cup sizes.

FIG. 20 illustrates a plurality of armatures 82-1, 82-2, 82-3, 82-4, 82-5, 82-6, 82-7, and 82-8 for assembly into the non-customized standard array of brassieres. The armature 82 is the subject of U.S. patent application Ser. No. 11/767,079, filed on Jun. 22, 2007 and entitled "ARMATURE FOR A BRASSIERE", the entire contents of which are incorporated by reference. The armature 82 has a distal portion 126 that terminates at the side crease mark 62 of the breast 122. A proximal portion 146 ends adjacent the center front distance 70.

Figure 21:
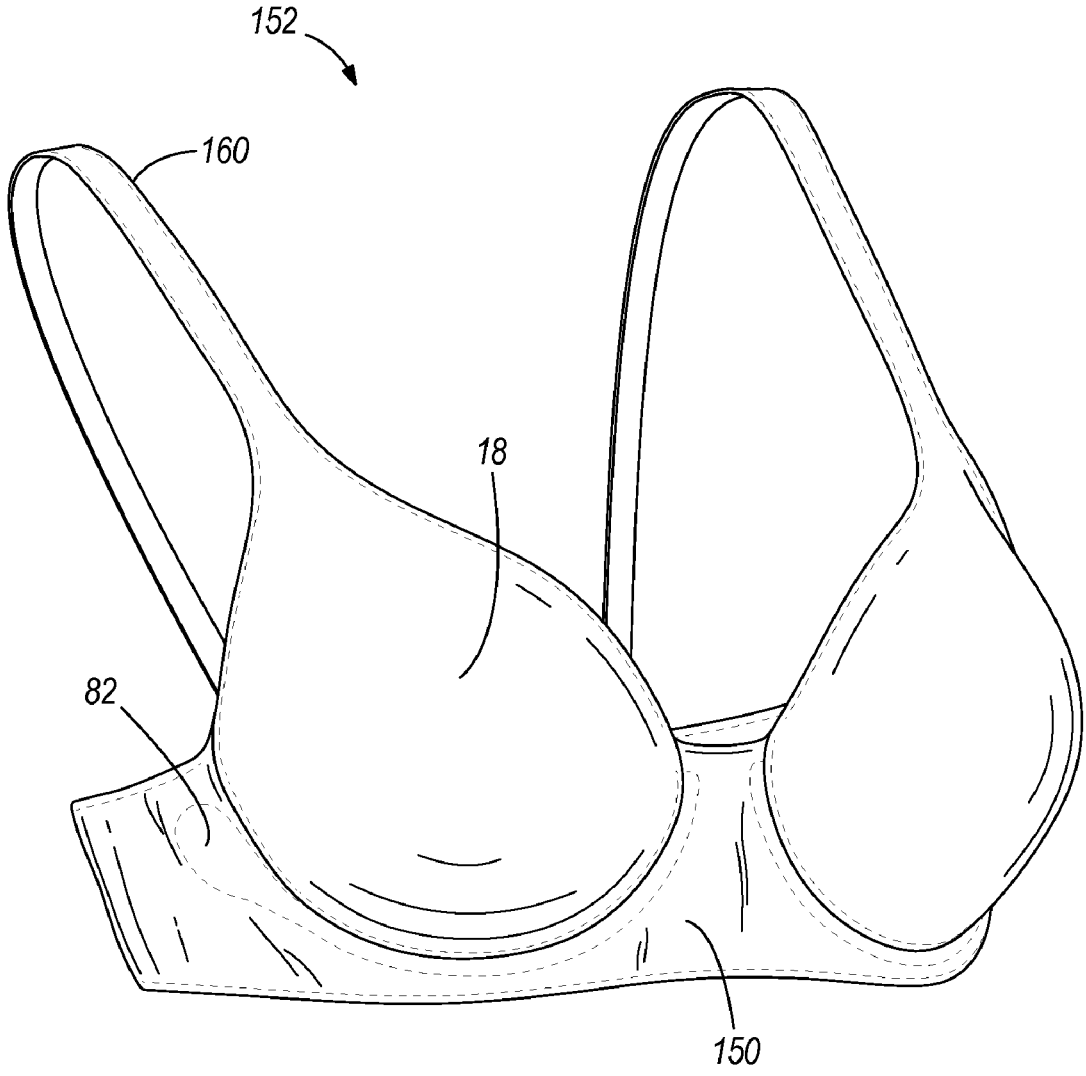
FIG. 21 illustrates one of a plurality of brassieres of a non-customized, standard array of brassieres manufactured from a fabric band generated from a corresponding band pattern, which was generated from a corresponding band of the grading array of FIG. 1.

FIG. 21 illustrates the resultant fabric band 150 generated from the corresponding band pattern 118. The fabric band 150 is used to build a non-customized standard brassiere 152 according to the grading array 10 of the present invention. The band pattern 118 may be scaled as necessary to account for fabric stretch such that the when the fabric is stretched by an acceptable stretching force, the stretched fabric will substantially match the original unscaled band pattern 118. For example, the band pattern 118 can be scaled down, and then the fabric band can be cut from the scaled band pattern. As such, fabric tolerances and stretch factors are accounted for when preparing a fabric band 150 from a band pattern 118, such that different fabric bands 150 may have different sizes based on the specific fabric characteristics even though they were generated from the same band pattern 118. In other words, a fabric band 150 having a greater fabric stretch will be cut slightly smaller than a fabric band 150 with a lesser stretch in order to accommodate for the fabric tolerances, or fabric stretch ratios.

As shown in FIG. 21, the armatures 82 are inserted into pockets created in the fabric band 150 at the base of each breast cup 18, which are then stitched to the fabric band 150. In other embodiments, the armatures may be embedded into materials in the brassiere, such as foam. In still other embodiments, the armatures may be stitched onto the brassiere. In further embodiments, the armatures may be coupled to the brassiere depending on the brassiere style and design. The brassiere 152 can be completed with, but not limited to the following, straps 160, adornments or other decoration.

The sizing identification system of the present invention utilizes a direct measurement of the girth, or underbust circumference rather than the indirect measurement found in traditional brassiere sizing. This system reduces consumer confusion regarding measurement and selection of the correct band size. The system involves direct measurement and requires no knowledge of a particular sizing equation or measurement manipulation for band selection in selection of a brassiere from one of the non-customized standard array of brassieres. Furthermore, the volume of each group directly corresponds to the volume obtained by using a measurement device for measuring breast volume such as, for example, a fabric sleeve.

In contrast to the direct measurement process of the present invention, band sizes for a traditional brassiere design are currently based on an approximately 30-inch to 48-inch band size. Traditional band size is based on direct underbust measurement with an additional four or five-inches added to the resultant band size to get an adjusted underbust size. Generally, four inches are added to an even underbust measurement, whereas, five inches are added to an odd underbust measurement. For example, a woman with a 30-inch direct underbust measurement would have a 34-inch final band size, and a woman with a 31-inch direct underbust measurement would have a 36-inch final band size. Next, the overbust, or bust at the fullest point, is measured in inches. The adjusted underbust is then subtracted from the overbust for a resultant value. The resultant value is then converted using Table 4 and used for traditional brassiere selection.

TABLE 4

| | Cup Size | | | | | | |
|---|---|---|---|---|---|---|---|
| | AA | A | B | C | D | DD | E |
| Resultant Value | −1 | 0 | 1 | 2 | 3 | 4 | 5 |

The commercially available brassieres of the present invention will be identifiable to a consumer by both the underband size and the breast volume measurement. For example, the commercially available, non-customized, standard array of brassieres will be identifiable by an underbust size range, such as 28-30, and a volume group, such as Group 1, Red, and the like. Accordingly, the consumer will be able to select from one of a plurality of non-customized, standard array of brassieres directly related to body measurements to provide a comfortable and well-fitted bra based on a sizing system that is easy for a consumer to understand.

For example, a consumer is sized for a particular brassiere size of the non-customized standard array of brassieres by first measuring the underbust (i.e., 29 inches). Next, the band size range is determined (i.e., 28-30). The breast size is then measured using a measurement device (i.e., 400 cc breast size measurement), and the cup size is determined. For example and with reference to Table 3, a 400 cc breast size measurement would likely use a volume group 2 cup size (348 cc). Alternatively, a consumer with a 400 cc breast size measurement may also try a volume group 3 cup size (499 cc). Finally, the band size and cup size measurements enable a consumer to select a suggested brassiere by comparison of ranges and sizes without mathematical manipulation of the measurements (i.e., a brassiere having a 28-30 underbust measurement with a volume group 2 cup size).

Various features and advantages of the invention are set forth in the following claims.

What is claimed is:

1. A non-customized standard array of brassieres comprising:

a plurality of fabric bands for extending around the underbust of a wearer and for being coupled with a pair of brassiere cups, the plurality of fabric bands generated from a corresponding plurality of bands of varying lengths corresponding to a plurality of underbust measurements, each of the plurality of bands having an arc-shaped portion having a substantially constant radius, the arc-shaped portion including a center point, a first end point on one side of the center point, and a second end point on the opposite side of the center point, wherein the first end point of each of the plurality of bands is located at an angular distance from the respective center point, wherein the angular distance is constant across the plurality of bands.

2. The non-customized standard array of brassieres of claim 1, wherein the angular distance is between 15 and 30 degrees.

3. The non-customized standard array of brassieres of claim 2, wherein the angular distance is between 20 and 25 degrees.

4. The non-customized standard array of brassieres of claim 3, wherein the angular distance is approximately 23 degrees.

5. The non-customized standard array of brassieres of claim 1, wherein the center point, first end point, and second end point are extracted from volumetric data collected by three-dimensionally scanning a series of models.

6. The non-customized standard array of brassieres of claim 1, wherein the plurality of bands includes bands including ten different lengths.

7. The non-customized standard array of brassieres of claim 1, wherein the plurality of fabric bands are generated from a corresponding plurality of band patterns which are generated from the plurality of bands, wherein the center point, the first end point, and the second end point of a band are located within the corresponding band pattern.

8. The non-customized standard array of brassieres of claim 7, wherein each band pattern includes a centerline that bisects the arc, and wherein each band pattern includes an attachment end extending from the first end point, the attachment end defining an angle relative to the centerline, and wherein the angle is constant across the plurality of band patterns.

9. The non-customized standard array of brassieres of claim 8, wherein the angle is between 15 and 30 degrees.

10. The non-customized standard array of brassieres of claim 9, wherein the angle is between 20 and 25 degrees.

11. The non-customized standard array of brassieres of claim 10, wherein the angle is approximately 23 degrees.

12. The non-customized standard array of brassieres of claim 7, wherein the plurality of band patterns are scaled relative to the corresponding bands-based on a fabric characteristic of a fabric used for the fabric bands.

13. A non-customized standard array of brassieres comprising:

a plurality of cup pairs, each cup pair in the plurality of cup pairs having a different size from another cup pair in the plurality of cup pairs, the different cup pairs sized for different breast volumes;

a plurality of fabric bands for extending around the underbust of a wearer, wherein one cup pair of the plurality of cup pairs is to be attached to each fabric band;

wherein each fabric band of the plurality of fabric bands includes a bridge defined by the distance between the cups of the cup pair attached to the fabric band, the distance varying across the plurality of fabric bands.

14. The non-customized standard array of brassieres of claim 13, wherein the plurality of fabric bands includes a first plurality of fabric bands having a common length and a second plurality of fabric bands having different lengths relative to each other, wherein the distance varies across the first and second plurality of fabric bands.

15. The non-customized standard array of brassieres of claim 13, wherein each cup of each cup pair of each brassiere is partially defined by a circle such that each cup pair is partially defined by a pair of circles, and wherein the distance is measured along a line that is perpendicular to the pair of circles and extends between the pair of circles.

16. The non-customized standard array of brassieres of claim 15, wherein the fabric band includes a center-back to crease measurement that is taken from a crease of a side of a breast to a center of a back of a wearer, the distance being a length of the fabric band minus twice the center-back to crease measurement and minus twice a diameter of the circle.

17. The non-customized standard array of brassieres of claim 14, wherein the distance varies across the first plurality of fabric bands based on the size of the cup pair attached to the fabric band.

18. The non-customized standard array of brassieres of claim 14, wherein the distance varies across the second plurality of fabric bands based on the size of the cup pair attached to the fabric band and the length of the fabric band.

19. The non-customized standard array of brassieres of claim 14, wherein the second plurality of fabric bands includes fabric bands including ten different lengths.

20. The non-customized standard array of brassieres of claim 13, wherein the plurality of cup pairs includes cup pairs including eight different sizes.

21. A non-customized standard array of brassieres comprising:

a first brassiere of a non-customized, standard array of brassieres, the first brassiere including a first fabric band having a first length and a first cup pair attached to the first fabric band and including a volume identifier corresponding to a predetermined breast volume, wherein each cup of the first cup pair is configured to contain a specified volume corresponding to the predetermined breast volume; and a second brassiere of the non-customized, standard array of brassieres, the second brassiere including a second fabric band having a second length different from the first length, the second brassiere including a second cup pair attached to the second fabric band and including the volume identifier, wherein each cup of the second cup pair is configured to contain the specified volume corresponding to the predetermined breast volume.

22. The non-customized standard array of brassieres of claim 21, wherein the volume identifier is one volume identifier of eight volume identifiers, each of the volume identifiers representative of a specified breast volume extracted from volumetric data collected by three dimensionally scanning a series of models.

23. The non-customized standard array of brassieres of claim 21, wherein the volume identifier corresponds with the predetermined breast volume.

24. The non-customized standard array of brassieres of claim 21, further comprising a third brassiere of the non-customized, standard array of brassieres, the third brassiere including a third fabric band having a third length different from the first and second, the third brassiere including a third cup pair attached to the third fabric band and including the volume identifier, wherein each cup of the third cup pair is configured to contain the specified volume corresponding to the predetermined breast volume.

25. The non-customized standard array of brassieres of claim 21, wherein the lengths of the first and second band are selected from a group of ten lengths extracted from volumetric data collected by three-dimensionally scanning a series of models.

26. A non-customized standard array of brassieres comprising:

a plurality of cup pairs;

a plurality of fabric bands generated from a plurality of bands including a first plurality of bands of varying lengths and a second plurality of bands having a common length, each of the plurality of bands defining an arc having a substantially constant radius and including a center point, a first end point on one side of the center point, and a second end point on the opposite side of the center point, wherein one cup pair of the plurality of cup pairs is attached to each fabric band;

wherein a cup of each cup pair of the plurality of cup pairs is located at an angular distance from the end point of the corresponding band, wherein the angular distance is constant across at least one of the first plurality of bands and the second plurality of bands.

27. The non-customized standard array of brassieres of claim 26, wherein the angular position is constant across the first plurality of bands and the second plurality of bands.

28. The non-customized standard array of brassieres of claim 26, wherein the angular distance is between 5 and 25 degrees.

29. The non-customized standard array of brassieres of claim 27, wherein the angular distance is between 10 and 20 degrees.

30. The non-customized standard array of brassieres of claim 28, wherein the angular distance is approximately 14.75 degrees.

31. The non-customized standard array of brassieres of claim 26, wherein the center point, first end point, and second end point are extracted from volumetric data collected by three dimensionally scanning a series of models.

32. The non-customized standard array of brassieres of claim 26, wherein the plurality of bands includes bands including ten different lengths.

33. The non-customized standard array of brassieres of claim 26, wherein the plurality of fabric bands are generated from a corresponding plurality of band patterns which are generated from the plurality of bands, wherein the center point, the first end point, and the second end point of a band are located within the corresponding band pattern.

34. The non-customized standard array of brassieres of claim 33, wherein the plurality of band patterns are scaled relative to the corresponding bands based on a fabric characteristic of a fabric used for the fabric bands.

35. The non-customized standard array of brassieres of claim 26, wherein each cup of the plurality of cup pairs is at least partially defined by a circular shape, and wherein each band includes an index line located at the angular distance from the end point, the cup being attached such that the index line is tangent to the circular shape.

36. The non-customized standard array of brassieres of claim 26, wherein the plurality of cup pairs include different sizes.

37. The non-customized standard array of brassieres of claim 26, wherein the plurality of cup pairs include a common size.

38. A non-customized standard array of brassieres comprising:

a plurality brassieres of the non-customized, standard array of brassieres, each brassiere of the plurality of brassieres including a fabric band having a length identifier corresponding to a predetermined underbust circumference, and a cup pair attached to the fabric band, wherein the cup pair includes a volume identifier corresponding to a predetermined breast volume, wherein each brassiere of the plurality of brassieres is identifiable by a consumer by the volume identifier and the length identifier.

39. The non-customized standard array of brassieres of claim 38, wherein the predetermined underbust size is extracted from volumetric data collected by three-dimensionally scanning a series of models.

40. The non-customized standard array of brassieres of claim 39, wherein the length identifier is one length identifier of ten length identifiers.

41. The non-customized standard array of brassieres of claim 38, wherein the predetermined breast volume is extracted from volumetric data collected by three-dimensionally scanning a series of models.

42. The non-customized standard array of brassieres of claim 38, wherein the volume identifier is one volume identifier of eight volume identifiers.

43. The non-customized standard array of brassieres of claim 38, wherein the volume identifier corresponds with the predetermined breast volume.

* * * * *